US010695654B1

(12) United States Patent
Williams, Jr.

(10) Patent No.: US 10,695,654 B1
(45) Date of Patent: Jun. 30, 2020

(54) DOUBLE-KINGPIN SKATEBOARD TRUCK INCORPORATING A NOVEL KEYWAY SLOT AND AN L-SHAPED KEYWAY BOLT

(71) Applicant: Alfred C. Williams, Jr., Benicia, CA (US)

(72) Inventor: Alfred C. Williams, Jr., Benicia, CA (US)

( * ) Notice: Subject to any disclaimer, the term of this patent is extended or adjusted under 35 U.S.C. 154(b) by 0 days.

(21) Appl. No.: 16/216,564

(22) Filed: Dec. 11, 2018

(51) Int. Cl.
*A63C 1/00* (2006.01)
*A63C 17/01* (2006.01)

(52) U.S. Cl.
CPC ..... *A63C 17/012* (2013.01)

(58) Field of Classification Search
CPC ..... A63C 17/012
See application file for complete search history.

(56) References Cited

U.S. PATENT DOCUMENTS 6,793,224 B2 * 9/2004 Stratton ..... A63C 17/01 280/87.041
7,104,558 B1 * 9/2006 Saldana ..... A63C 17/0093 280/11.27
9,145,030 B2 * 9/2015 Williams ..... B60B 35/025
9,643,076 B2 * 5/2017 Aamodt ..... A63C 17/015
2005/0051983 A1 * 3/2005 Williams ..... A63C 17/0093 280/87.042
2005/0051984 A1 * 3/2005 Williams ..... A63C 17/0093 280/87.042
2011/0210526 A1 * 9/2011 Williams, Jr. ..... A63C 17/0093 280/11.28
2013/0270781 A1 * 10/2013 Kuyt ..... A63C 17/012 280/11.28

* cited by examiner

*Primary Examiner* — Brian L Swenson
(74) *Attorney, Agent, or Firm* — Pharar Patents & Intellectual Property; Andrew A. Pharar

(57) ABSTRACT

A novel double-kingpin skateboard truck is disclosed herein. The novel truck comprises, generally, an intermediary member with a keyway slot that receives an L-shaped keyway bolt. A plurality of risers may be installed on the keyway bolt to raise or lower the overall height of the truck and, thus, the height of an attached skateboard above the ground. The design of the truck allows for increased lateral articulation of the truck when its height is maximized, thus allowing for tighter leaning and turning of the skateboard, while limiting lateral articulation in its lowest height articulation, resulting in increased lateral stability and the ability to operate the skateboard more safely at higher speeds.

20 Claims, 11 Drawing Sheets

DOUBLE-KINGPIN SKATEBOARD TRUCK INCORPORATING A NOVEL KEYWAY SLOT AND AN L-SHAPED KEYWAY BOLT

TECHNICAL FIELD OF THE INVENTION

The present invention relates in general to skateboard trucks, and, more specifically, to a double-kingpin skateboard truck incorporating a novel keyway slot and an L-shaped keyway bolt.

BACKGROUND OF THE INVENTION

A double-kingpin skateboard truck, for example, as disclosed in U.S. Pat. No. 7,150,460, is distinguished from a single-kingpin skateboard truck by the double-kingpin truck's particular incorporation of a truck insert, which is attached between the axle and the base plate of a single-kingpin skateboard truck. More particularly, a known double-kingpin truck, as shown in FIG. 15, comprises a skateboard truck insert, as shown in FIG. 16, capable of being positioned between a base plate and an axle of a skateboard truck. The truck insert generally comprises an intermediary member; a truck insert pivot pin projecting from the intermediary member for positioning in a pivot pin receiving hole in the base plate; a mounting portion at a first end of the intermediary member with an oversized through hole; a blind hole at an end of the intermediary member opposite the first end for receiving a pivot pin projecting from the axle, and an axle bolt hole for receiving a 2 to 3 inch axle bolt extending from the axle, where the axle bolt hole is spaced from the blind hole and is located in the intermediary member between the mounting portion and the blind hole.

The inclusion of the extra 2 to 3 inch truck insert bolt, two bushings, insert pivot pin, and other components required for the truck insert component provides the double-kingpin skateboard truck a hyper-turning and hyper-traction ability, in comparison to a typical single-kingpin skateboard truck. The double-kingpin truck geometry is, therefore, well-suited for skateboard carving, pumping, slalom riding, and sidewalk surfing purposes. However, the same extra truck components required by the inclusion of the truck insert also cause the double-kingpin skateboard truck to have a much taller truck height profile, and also to be much more flexible than a single-kingpin skateboard truck, making the setup much less suitable for high-speed skateboard riding purposes. To address the truck height and speed stability problems inherent in such double-kingpin trucks, it is of great utility and benefit to lower the overall height profile of the skateboard truck as low as mechanically possible so as to reduce the overall center of gravity of the entire skateboard.

In U.S. Patent Publication 2005/0051983 a double-kingpin truck, as shown in FIG. 17, is disclosed. The truck comprises a second kingpin 200 with pivot end 199 that may be inserted into a face 208 of a base plate 207. However, one major deficiency associated with this prior art truck is that the intermediary member 201 in the truck has no mechanism disclosed for rotational restraint, or fixed alignment, of the second kingpin bolt 200 within the intermediary member 201 of the skateboard truck mechanism 400. Lacking such directional alignment and rotational restraint of the second kingpin 200 within the prior art intermediary member 201, predictable turning and directional control of the skateboard onto which the truck is installed is either not possible or severely inhibited. Without having a means of directional alignment, the leverage exerted on the intermediary member 201 from the combined compressional forces of the skate wheels 224 and the tilt of the deck from the skateboard rider's weight while riding, would force the mounting portion 202 of the truck to swing laterally back and forth relative to the bolt 203. This lateral pivoting and rotation of the mounting portion 202 around the bolt 203 can result in unwanted metal to metal contact between the mounting portion 202 with the bolt 203, which is rigidly fixed into the base plate 207 and passes through the middle of the mounting portion 202 of the intermediary member 201. Because of such unwanted, unpredictable, and uncontrollable rotation of the mounting portion, there is a high likelihood that after frequent contact with said bolt 203, the structural integrity of the aluminum mounting portion 202 would eventually fail and break. Because of this highly predictable mechanical hazard this particular prior art truck design is not suitable for safe skateboarding purposes, and a means of addressing this obvious deficiency is a primary goal of the present invention.

Thus, there is a need in the art for a double-kingpin skateboard truck incorporating a novel keyway slot and an L-shaped keyway bolt that safely integrates the double-kingpin modification while allowing for height-adjustability and improved high-speed performance characteristics.

BRIEF SUMMARY OF THE INVENTION

To minimize the limitations in the prior art, and to minimize other limitations that will be apparent upon reading and understanding the present specification, the present invention describes a double-kingpin skateboard truck incorporating a novel keyway slot and an L-shaped keyway bolt.

It is an objective of the present invention to provide a double-kingpin skateboard truck that may comprise a plurality of spacers.

It is another objective of the present invention to provide a double-kingpin skateboard truck that may be height-adjustable.

It is another objective of the present invention to provide a double-kingpin skateboard truck that may allow for very tight turning of a skateboard.

It is another objective of the present invention to provide a double-kingpin skateboard truck that may allow for high-speed stability of a skateboard.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

Figure 1:
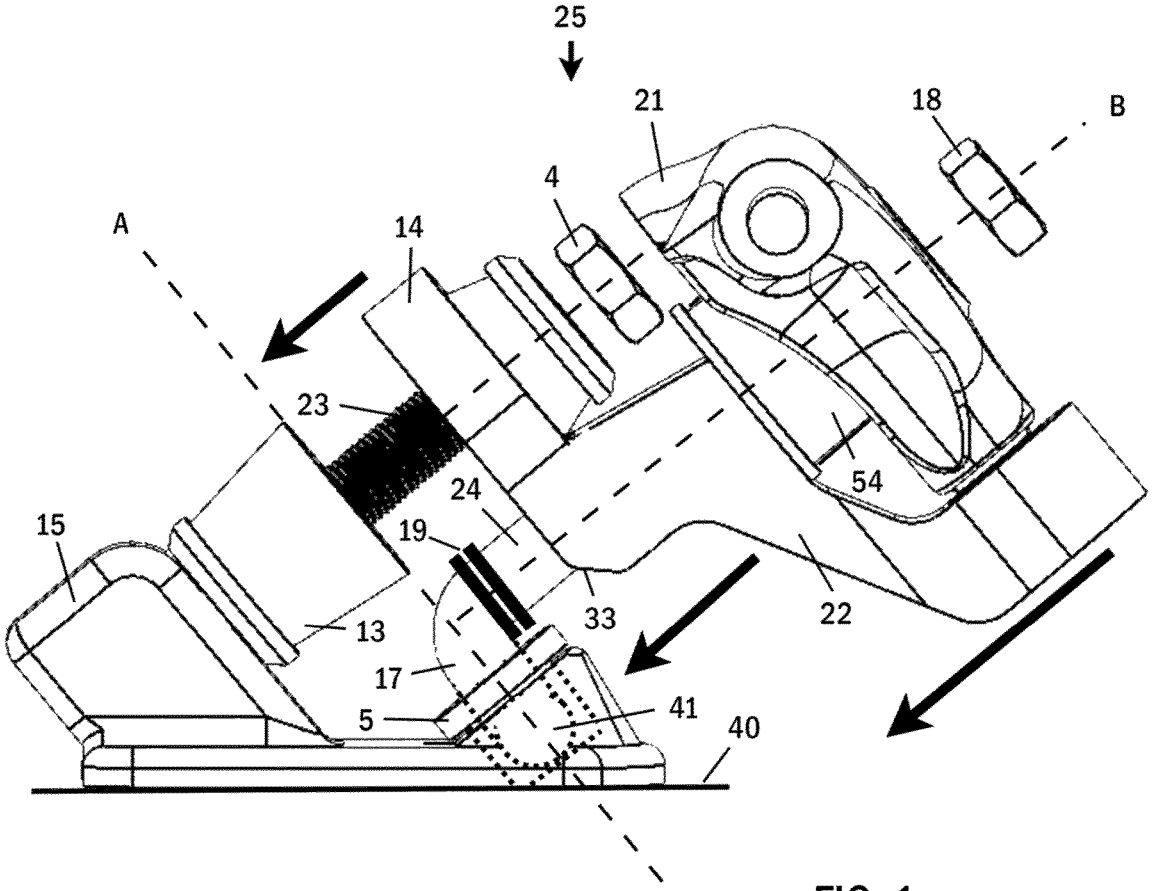
FIG. 1 illustrates a partially-exploded side view of a double-kingpin skateboard truck incorporating a novel keyway slot and an L-shaped keyway bolt, as contemplated by the present disclosure.

The illustration of FIG. 1 illustrates a partially-exploded side view of a double-kingpin skateboard truck incorporating a novel keyway slot and an L-shaped keyway bolt. The illustration identifies an L-shaped keyway bolt 24 having a short end 17, the short end 17 further comprising a pivot tip 41 extending into a shock absorbing pivot cup 5 on a first end of base plate 15. Two truck height riser washers 19 are also visible and positioned around a long end of said bolt 24. Arrows in the illustration show the direction of installing the various truck insert components and truck hanger components onto the truck base plate 15.

Figure 2:
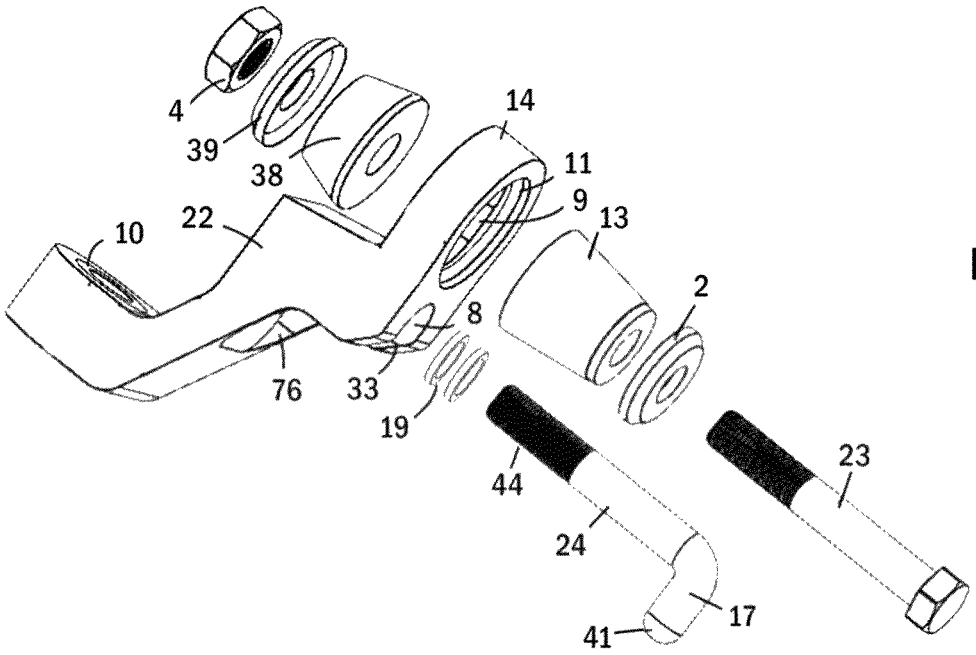
FIG. 2 illustrates an exploded view of a truck insert of a double-kingpin skateboard truck incorporating a novel keyway slot and an L-shaped keyway bolt, as contemplated by the present disclosure.

The illustration of FIG. 2 illustrates an exploded view of a truck insert of a double-kingpin skateboard truck incorporating a novel keyway slot and an L-shaped keyway bolt. The illustration identifies a truck insert integrating an intermediary member 22, keyway slot 33, recess portion 76, through hole 9, blind hole 10, bushing stop 11, and mounting portion 14. The figure further illustrates a first bushing washer 2, hex nut 4, keyway bolt hole 8, first bushing 13, riser washer 19, kingpin bolt 23, L-shaped keyway bolt 24 having a short end 17 and a long threaded end 44, keyway slot 33, second bushing 38, second bushing washer 39, and pivot tip 41.

Figure 3:
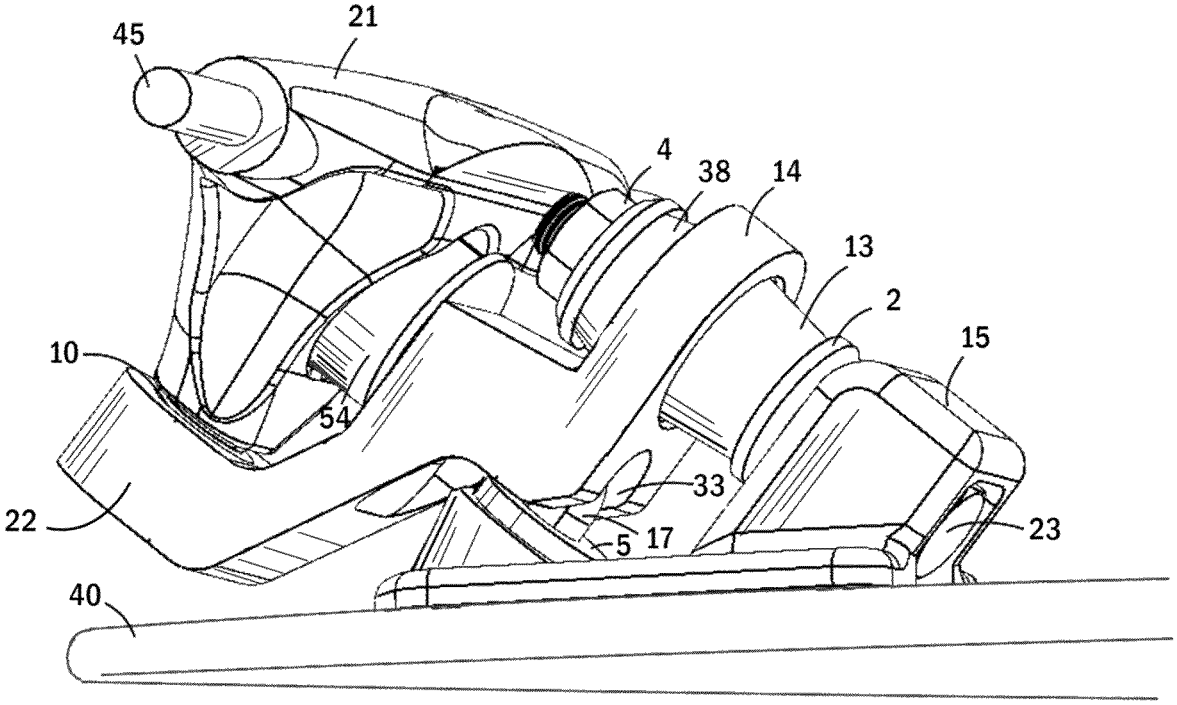
FIG. 3 illustrates an overview of a double-kingpin skateboard truck incorporating a novel keyway slot and an L-shaped keyway bolt, as contemplated by the present disclosure.

The illustration of FIG. 3 illustrates an overview of a double-kingpin skateboard truck incorporating a novel keyway slot and an L-shaped keyway bolt. The intermediary member 22 is shown to be installed between the truck base plate 15 and truck hanger 21.

Figure 4:
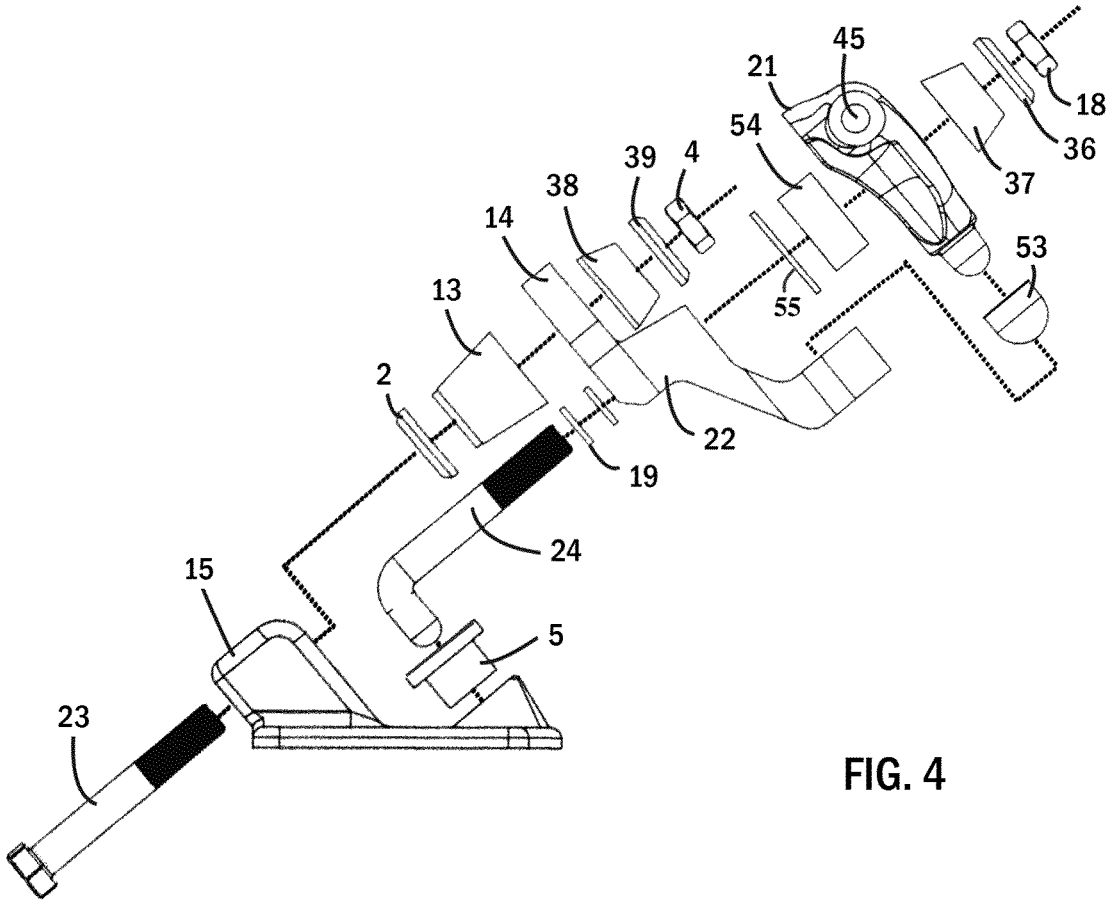
FIG. 4 illustrates an exploded side view of a double-kingpin skateboard truck incorporating a novel keyway slot and an L-shaped keyway bolt, as contemplated by the present disclosure.

The illustration of FIG. 4 illustrates an exploded side view of a double-kingpin skateboard truck incorporating a novel keyway slot and an L-shaped keyway bolt. The figure illustrates the method by which the intermediary member 22 mounts to the base plate 15 using the same mounting points as the original truck hanger 21, namely the bolt receiver and pivot pin combination. The truck hanger 21 then mounts to the intermediary member 22 using the same mounting points, though integrating the modifications disclosed herein.

Figure 5:
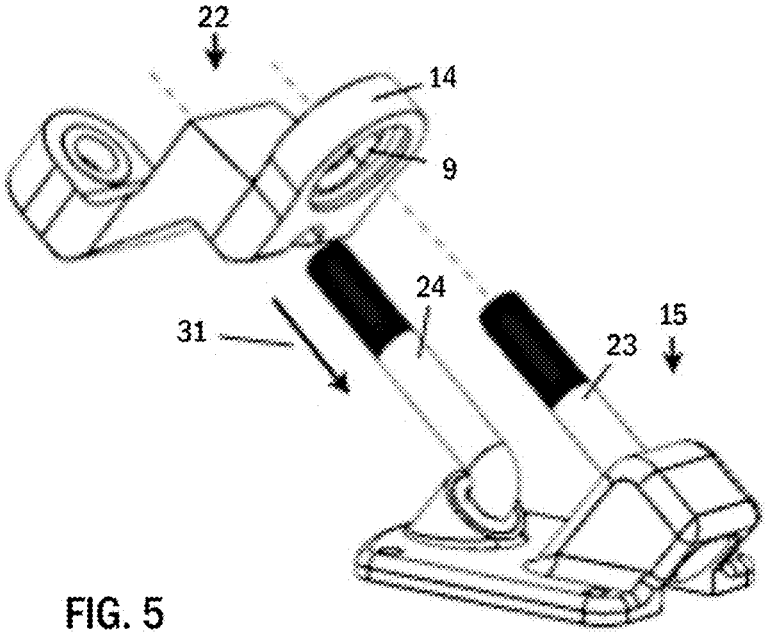
FIG. 5 illustrates a relative orientation of an intermediary member and a base plate of a double-kingpin skateboard truck incorporating a novel keyway slot and an L-shaped keyway bolt, as contemplated by the present disclosure.

The illustration of FIG. 5 illustrates a relative orientation of an intermediary member and a base plate of a double-kingpin skateboard truck incorporating a novel keyway slot and an L-shaped keyway bolt, which doesn't include any bushings or washers installed, but demonstrates how the intermediary member 22 can be installed onto a base plate kingpin bolt 23 and L-shaped keyway bolt 24, and where both said bolts can be viewed extending from their positions installed in base plate 15 of the novel double kingpin skateboard truck.

Figure 6:
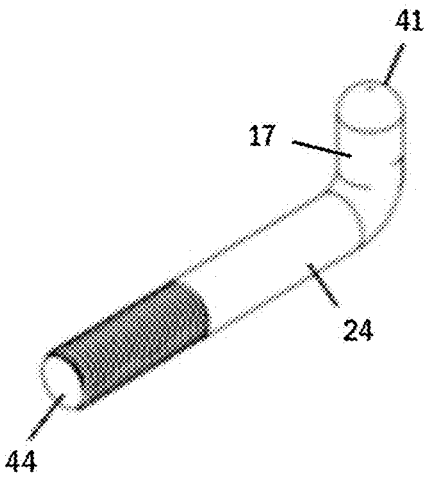
FIG. 6 illustrates an L-shaped keyway bolt of a double-kingpin skateboard truck incorporating a novel keyway slot and an L-shaped keyway bolt, as contemplated by the present disclosure.

The illustration of FIG. 6 illustrates an L-shaped keyway bolt of a double-kingpin skateboard truck incorporating a novel keyway slot and an L-shaped keyway bolt. The L-shaped keyway bolt 24 comprises a long threaded end 44, a short end 17, and a pivot tip 41. As contemplated by the present disclosure, the short end 17 of the L-shaped keyway bolt 24 is inserted into the pivot cup 5 on the base plate 15, and the long threaded end 44 of the L-shaped keyway bolt 24 passes through the keyway bolt hole 8 of the intermediary member 22.

Figure 7:
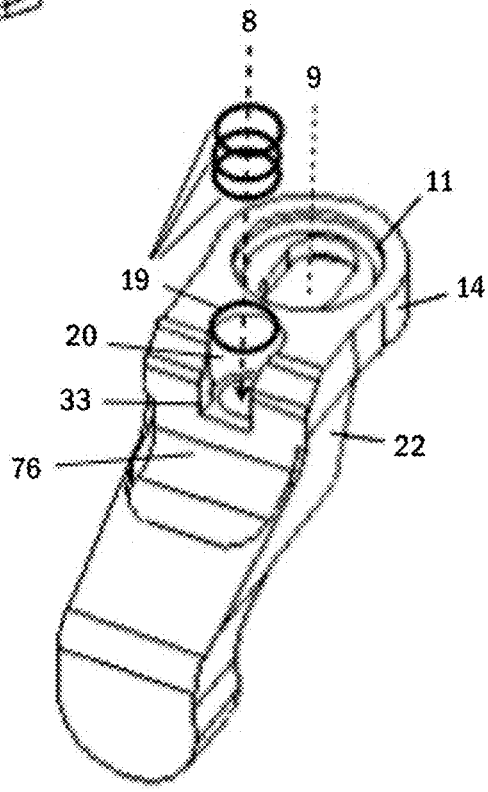
FIG. 7 illustrates an intermediary member of a double-kingpin skateboard truck incorporating a novel keyway slot and an L-shaped keyway bolt, as contemplated by the present disclosure.

The illustration of FIG. 7 illustrates an intermediary member 22, specifically identifying a keyway slot 33 and a keyway bolt hole 8. The keyway slot 33 may engage a first and second lateral side of the short end 17 of the L-shaped keyway bolt 24 so as to prevent lateral torsion and torquing movements of the L-shaped keyway bolt 24. Also detailed is a recess portion 76 of the intermediary member 22, adjacent said slots and holes in said intermediary member 22, and which recess portion 76 is suitable for positioning against a shock absorbing pivot cup 5 located on one end of the novel truck base plate 15.

Figure 8:
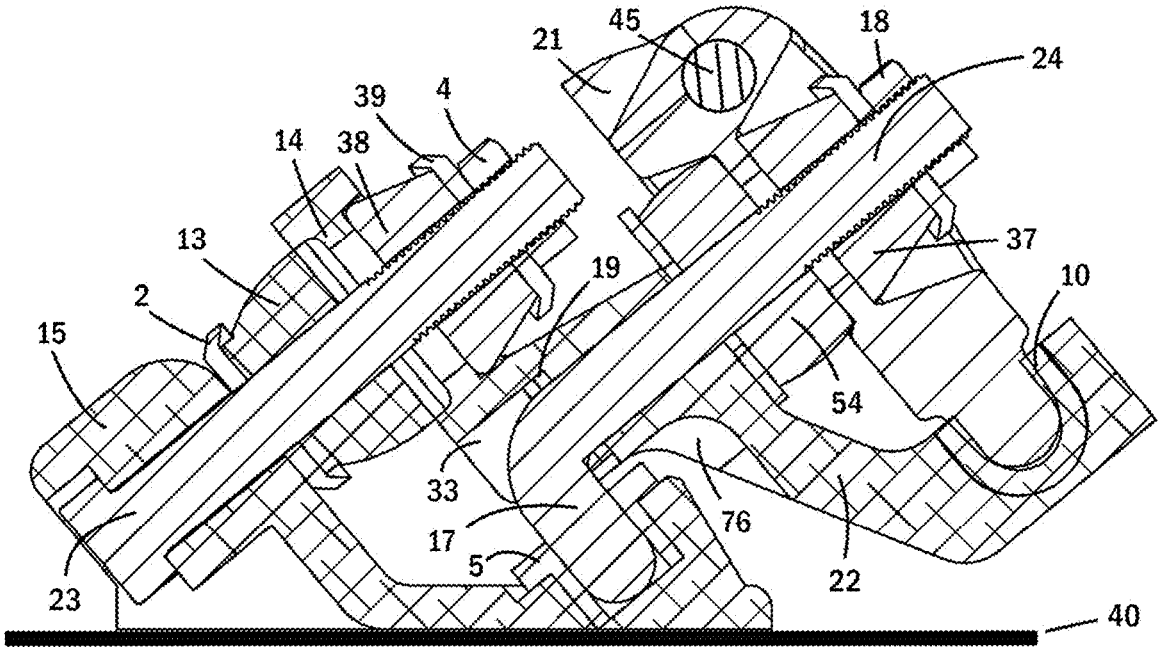
FIG. 8 illustrates a cross-sectional view of a double-kingpin skateboard truck incorporating a novel keyway slot and an L-shaped keyway bolt, as contemplated by the present disclosure.

The illustration of FIG. 8 illustrates a cross-sectional view of a double-kingpin skateboard truck incorporating a novel keyway slot and an L-shaped keyway bolt and its various components.

Figure 9:
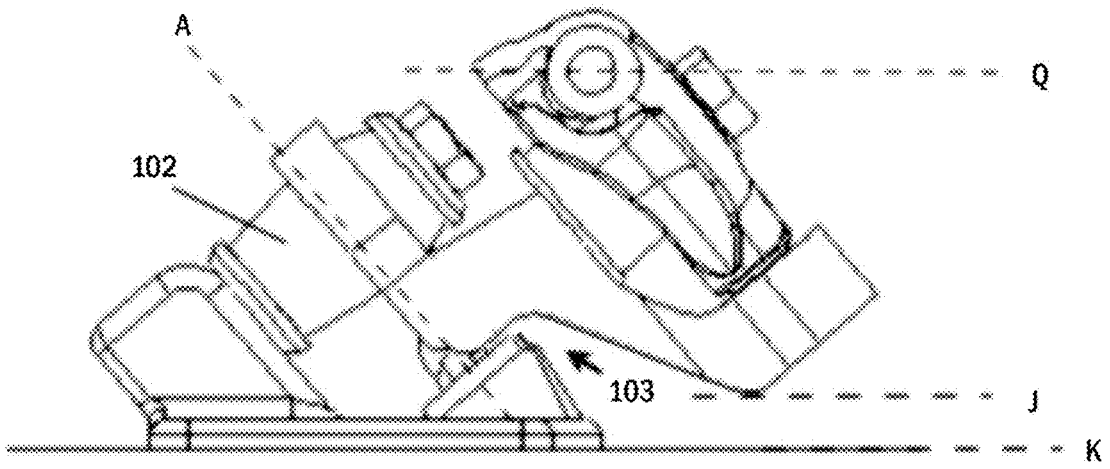
FIG. 9 illustrates a side perspective view of a double-kingpin skateboard truck incorporating a novel keyway slot and an L-shaped keyway bolt, as contemplated by the present disclosure.
Figure 10:
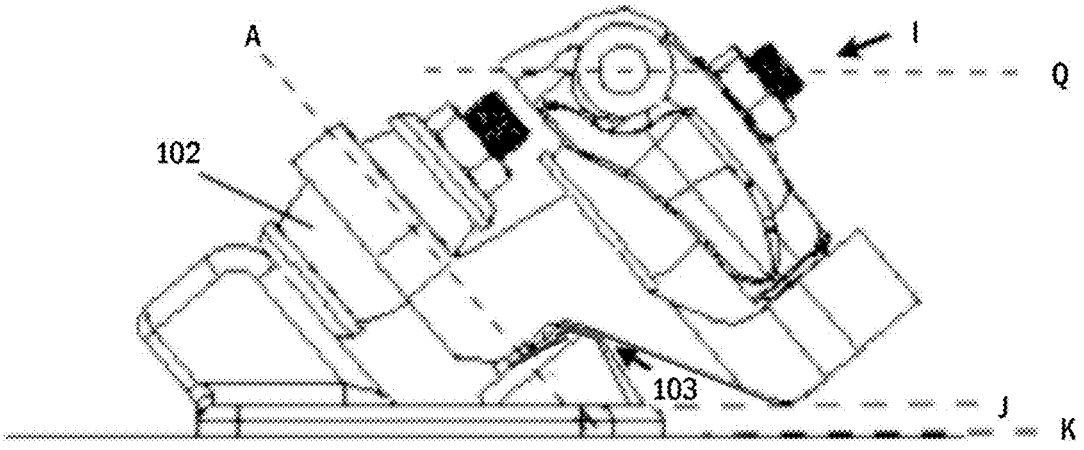
FIG. 10 illustrates a side perspective view of a double-kingpin skateboard truck incorporating a novel keyway slot and an L-shaped keyway bolt, as contemplated by the present disclosure.

The illustrations of FIGS. 9 and 10 illustrate a side perspective view of a double-kingpin skateboard truck incorporating a novel keyway slot and an L-shaped keyway bolt. FIG. 9 depicts a side view perspective of a novel truck detailing the position and height distance of the intermediary member 22 in relation to a shock absorbing pivot cup 5 located in the base plate 15 of the novel truck when six truck height riser washers are installed over the L-shaped keyway bolt 24 into the intermediary member 22 of said novel truck. In this figure no frictional contact can be seen between said pivot cup 5 and the recess portion 76 of the novel intermediary member 22, as is indicated by arrow 103.

FIG. 10 depicts a side view perspective of a novel truck detailing the position and height of the intermediary member in relation to a shock absorbing pivot cup 5 located in the base plate 15 of the novel truck and wherein no truck riser washers are installed over the L-shaped keyway bolt 24 into the intermediary member 22 of said novel truck. This is the lowest height position possible on the novel skateboard truck and tensioned frictional contact can be seen between the area of the recess portion 76 on the intermediary member 22 and the shock absorbing pivot cup 5 in the base plate 15 as indicted by arrow 103. This position provides the highest level of speed stability to the novel truck mechanism by permitting the least amount of relative movement between the base plate 15 and intermediary member 22.

Figure 11:
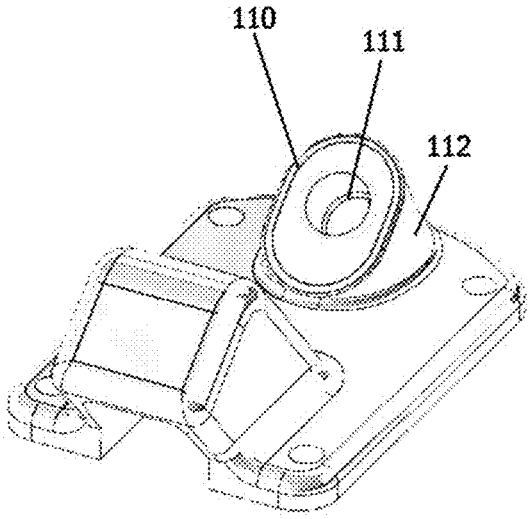
FIG. 11 illustrates an isometric perspective view of a base plate of a double-kingpin skateboard truck incorporating a novel keyway slot and an L-shaped keyway bolt, as contemplated by the present disclosure.
Figure 12:
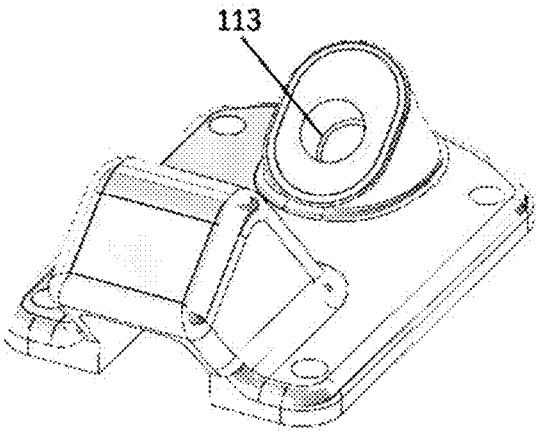
FIG. 12 illustrates an isometric perspective view of a base plate of a double-kingpin skateboard truck incorporating a novel keyway slot and an L-shaped keyway bolt, as contemplated by the present disclosure.

The illustrations of FIGS. 11 and 12 illustrate an isometric perspective view of a base plate of a double-kingpin skateboard truck incorporating a novel keyway slot and an L-shaped keyway bolt. The base plate 15 incorporates an oval-shaped shock absorbing pivot cup 5 with an offset pivot receiving hole 111. This oval shaped pivot cup 5 can be reversed so that the pivot receiving hole 113 is positioned closer to the bottom of the baseplate as seen in FIG. 12, which allows for lower height bushings to be installed on the novel truck mechanism, and which can add a higher degree of speed stability to the novel truck.

Figure 13:
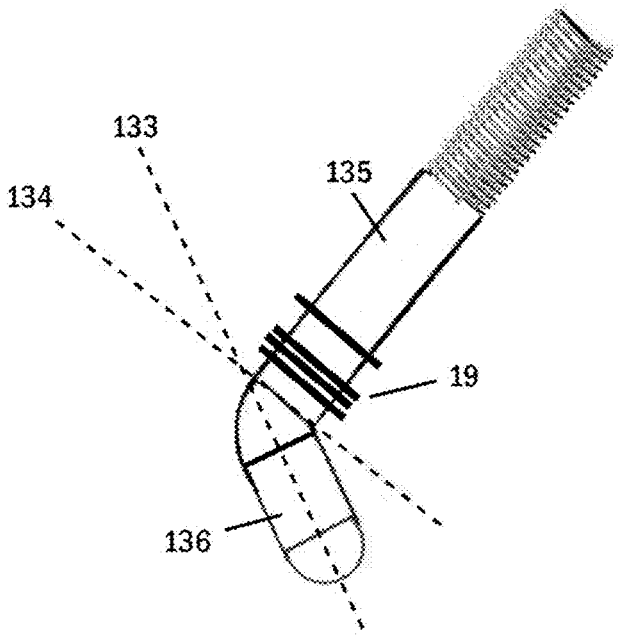
FIG. 13 illustrates a side-perspective view of an L-shaped keyway bolt of a double-kingpin skateboard truck incorporating a novel keyway slot and an L-shaped keyway bolt, as contemplated by the present disclosure.

The illustration of FIG. 13 illustrates a side-perspective view of an L-shaped keyway bolt of a double-kingpin skateboard truck incorporating a novel keyway slot and an L-shaped keyway bolt. In an alternative embodiment of an L-shaped keyway bolt 135; it is seen that the short end 136 of keyway bolt 135 is not bent at a 90-degree angle, but still is utilized with novel truck height spacer washers 19 so as to be raised and lowered in a keyway slot designed for this particular alternative embodiment component.

Figure 14:
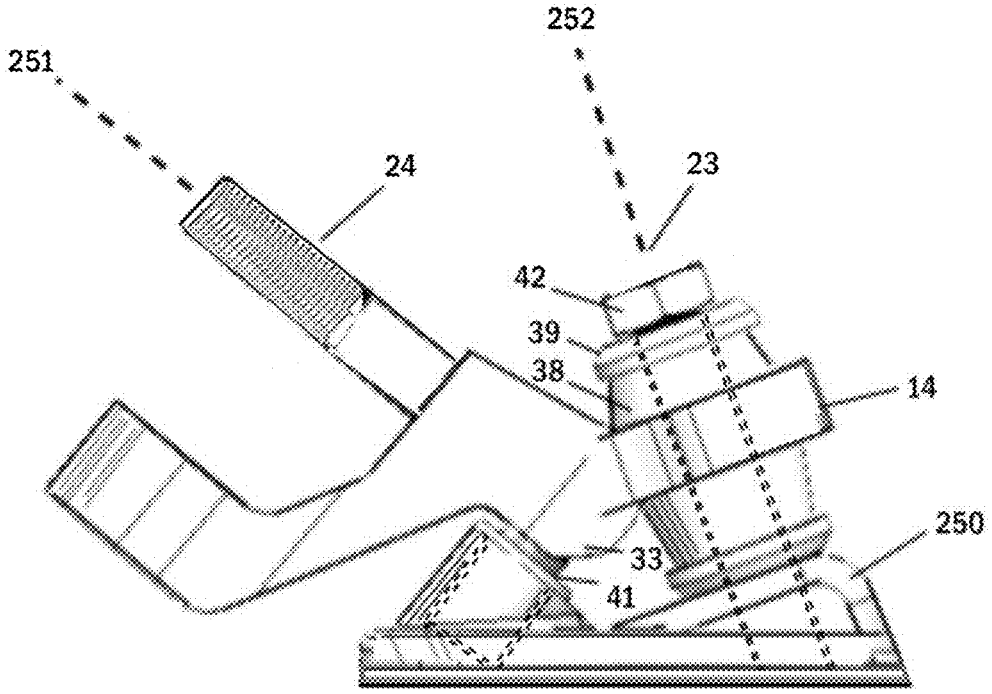
FIG. 14 illustrates a side perspective view of a double-kingpin skateboard truck incorporating a novel keyway slot and an L-shaped keyway bolt, as contemplated by the present disclosure.
Figure 15:
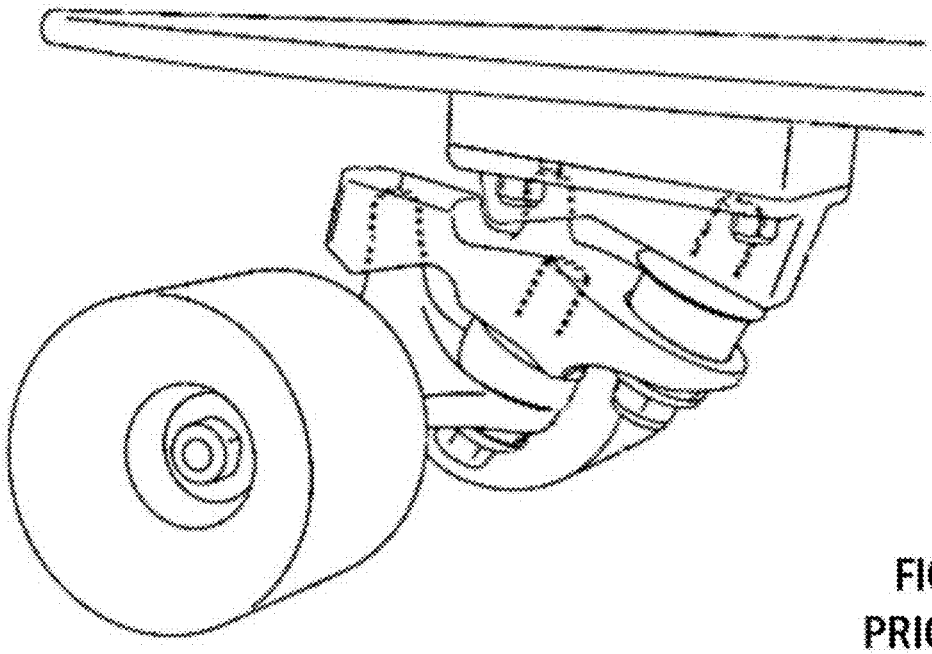
FIG. 15 PRIOR ART
FIG. 15 illustrates a prior art double kingpin truck as disclosed in U.S. Pat. No. 7,150,460.
Figure 16:
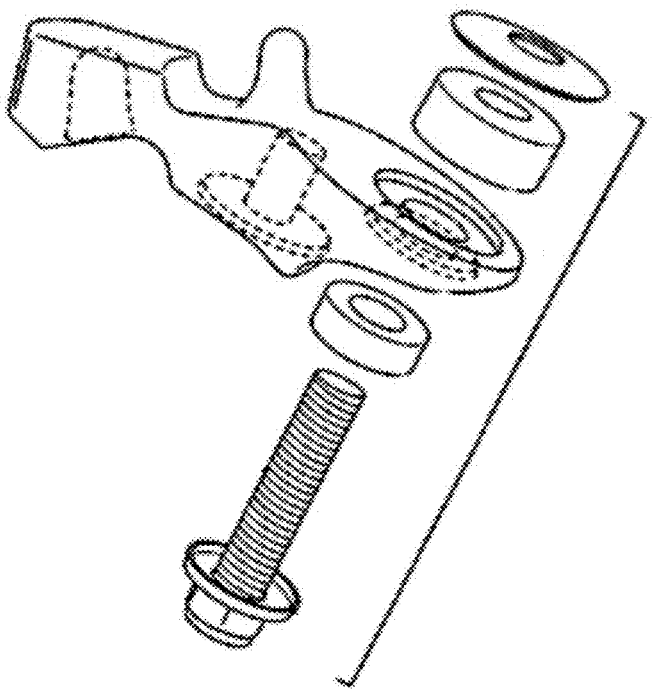
FIG. 16 PRIOR ART
FIG. 16 illustrates a prior art double kingpin truck as disclosed in U.S. Pat. No. 7,150,460.
Figure 17:
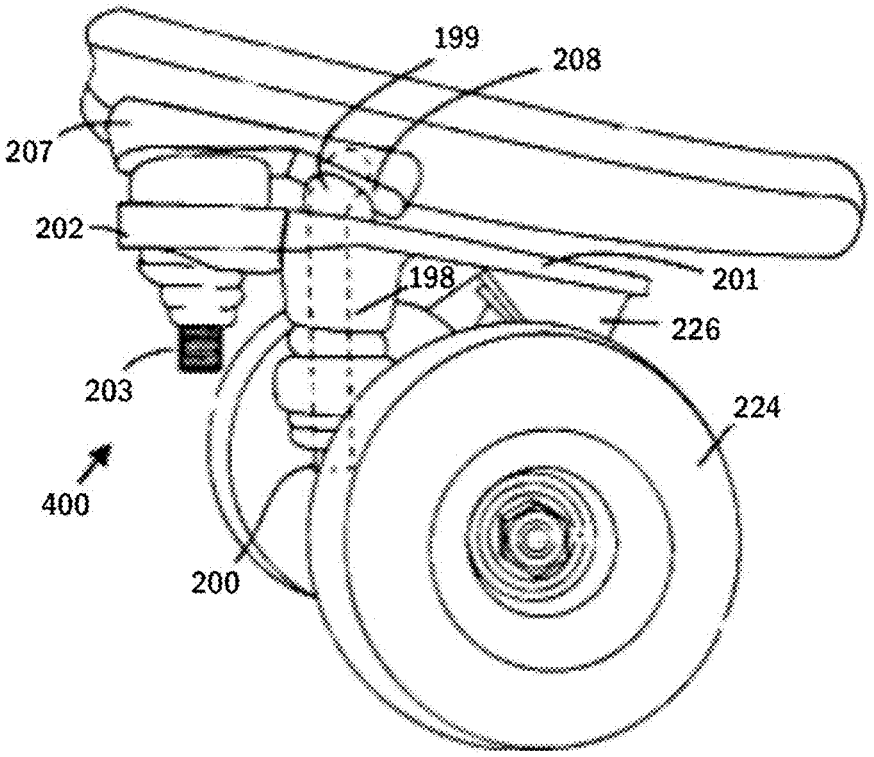
FIG. 17 PRIOR ART
FIG. 17 illustrates a prior art double kingpin truck as disclosed in U.S. Patent Publication 2005/0051983.
Figure 18:
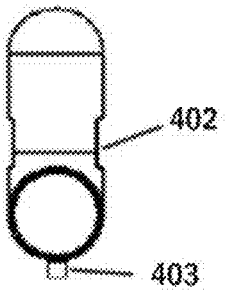
FIG. 18 illustrates a second embodiment of an L-shaped keyway bolt of a double-kingpin skateboard truck incorporating a novel keyway slot and an L-shaped keyway bolt, as contemplated by the present disclosure.
Figure 19:
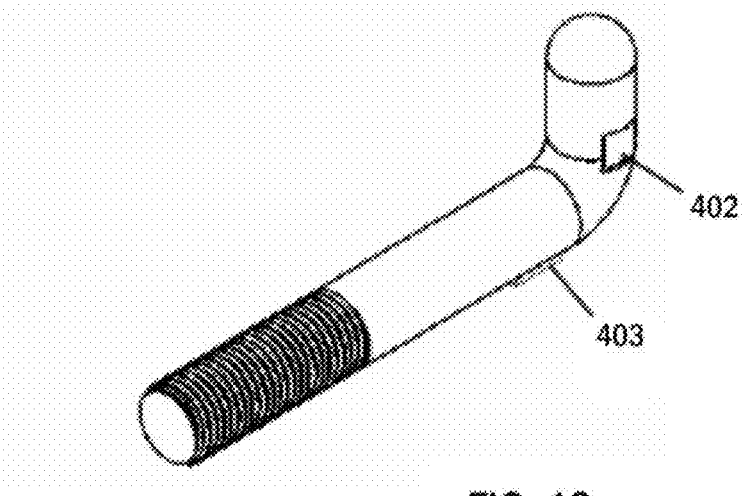
FIG. 19 illustrates a second embodiment of an L-shaped keyway bolt of a double-kingpin skateboard truck incorporating a novel keyway slot and an L-shaped keyway bolt, as contemplated by the present disclosure.
Figure 20:
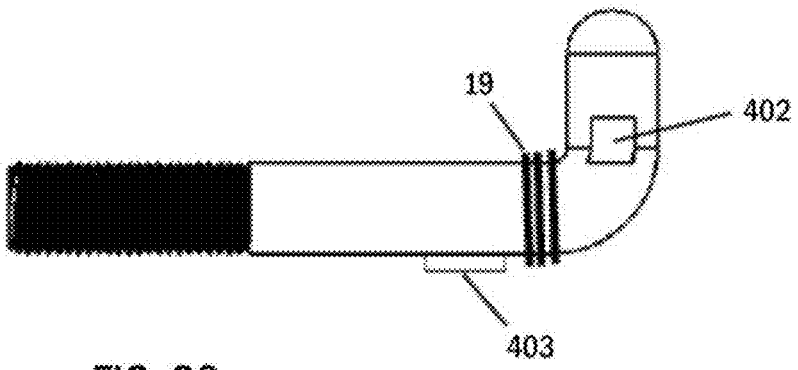
FIG. 20 illustrates a second embodiment of an L-shaped keyway bolt of a double-kingpin skateboard truck incorporating a novel keyway slot and an L-shaped keyway bolt, as contemplated by the present disclosure.

The illustration of FIG. 14 illustrates a side perspective view of a double-kingpin skateboard truck incorporating a novel keyway slot and an L-shaped keyway bolt, but without the truck hanger installed for better viewing. This design has bolts that are not parallel to each other, as is indicated by dashed lines 251 and 252, but still incorporates an L-shaped keyway bolt 24 and the keyway slot 33. A shortened base plate 250 is also depicted, with bolt 42 positioned in a "reverse kingpin" geometrical position. The same bolt 42 could also be reversed in its position in the hole, or alternatively a knurled compression bolt could replace it, said compression bolt having the threads pointed in the same direction as the L-shaped keyway bolt 24.

Figure 21:
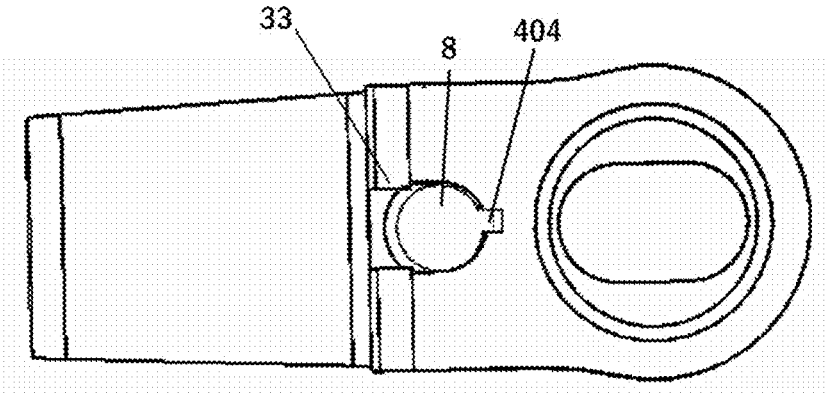
FIG. 21 illustrates a second embodiment of an intermediary member of a double-kingpin skateboard truck incorporating a novel keyway slot and an L-shaped keyway bolt, as contemplated by the present disclosure.

The illustrations of FIGS. 18 through 21 illustrate a second embodiment of an L-shaped keyway bolt and a second embodiment of an intermediary member of a double-kingpin skateboard truck incorporating a novel keyway slot and an L-shaped keyway bolt. The illustrations specifically identify a plurality of notches 402 in the short end 17 of the L-shaped keyway bolt 24, and a notch insert 403 on the long threaded end 44 of the L-shaped keyway bolt 24. FIG. 21 identifies that the intermediary member 22 further comprises an insert receiver 404 into which may be inserted the notch insert 403 of the L-shaped keyway bolt 24, and an extended keyway slot 33, which may be inserted into the plurality of notches 402 in the short end 17 of the L-shaped keyway bolt 24. By these mechanisms additional lateral support and torsional resistance is provided to the L-shaped keyway bolt 24, so as to prevent unwanted relative movement between the intermediary member 22 and the base plate 15 known to be a problem in the prior art.

Embodiments of the present disclosure generally relate to a double-kingpin skateboard truck incorporating a novel truck insert that includes a height adjustable L-shaped keyway bolt 24, an intermediary member 22 with a keyway slot 33, and various truck height riser washers 19, for the purpose of providing said double-kingpin truck with a multitude of truck adjustability options ranging from a super tight turn setting for slalom and sidewalk surfing, to a high speed stability setting for purposes of carving and high speed downhill riding. More specifically, embodiments of the present invention relate to a novel double-kingpin skateboard truck for increased safety and stability of riders of a skateboard incorporating the same.

One means of mechanically effecting an overall truck height reduction in a double-kingpin truck can be accomplished by the novel usage of a L-shaped keyway bolt 24, which L-shaped keyway bolt 24 incorporates a pivot tip 41 on one end, such that the L-shaped keyway bolt 24 has the ability to be height adjusted inside a novel intermediary member 22, and which height adjustability is shown by the arrows of FIG. 1.

Also shown in FIG. 1 are examples of two truck height riser washers 19 that are capable of fitting inside a washer receiving hole 20 in said intermediary member 22, and wherein zero to ten such truck height riser washers 19 are capable of being installed into said washer receiving hole 20, formed into said novel intermediary member 22. This type of truck height washer 19 installation gives a rider the ability to controllably lower or raise the overall truck height profile of said double-kingpin truck 25, by either removing all of the said riser washers 19 from said truck mechanism 25, or by adding the exact number of washers needed for any specific skateboard riding trick or purpose.

In the lowest truck height profile setting, wherein no truck height riser washers are installed, the intermediary member 22 of said truck insert can make tensioned frictional contact with a specially-designed shock absorbing pivot cup 5. An example of this frictional contact is depicted in FIG. 10 and the area affected is detailed by arrow 103. When the two hex nuts seen in FIG. 10 are tightened to their fullest reasonable tension, intermediary member 22 can be highly restricted from its normal rotational movement on the skateboard truck mechanism. This essential restraint of the said intermediary member 22 acts to make the double-kingpin truck ride similar to a typical single-kingpin skateboard truck, because the hyper turning steering capabilities added to the truck by the use of the intermediary member 22 are significantly disabled. Moreover, when normal double-kingpin hyper turning capabilities are desired, a skateboard rider can then install up to about ten or more small truck height riser washers 19 to raise the said intermediary member 22 off of the said shock absorbing pivot cup washer 5, as detailed by the arrow 103 in FIG. 9. The truck height riser washers 19 therefore are useful for separating the intermediary member 22 from any possible frictional contact with the said shock absorbing pivot cup 5 positioned into the double-king pin truck base plate 15. Without tensioned frictional resistance with the shock absorbing pivot cup 5, due to the installation of the washers 19, the intermediary member 22 is free to rotate laterally, and make super sharp turns, to the degree that the rider desires for his specific tricks or riding needs.

Moreover, it might be noted that the said height adjustments affecting the truck mechanism 25 are not vertical, but rather are angled, see FIG. 1 dashed line B, and also FIG. 5 arrow 31, wherein the said raising and lowering occurs at an angle generally corresponding to the angle of the long end 44 of the L-shaped keyway bolt 24. In an alternative embodiment seen in FIG. 14, a dashed line 251 reveals that such raising and lowering can also occur in a truck having non-parallel bolt angles 251 and 252. This alternative type truck design has a lesser ability to add as many riser washers 19 due to the particular diverging angles of the bolts 251 and 252, but they still can allow up to about four washers without adversely affecting truck function. Also, when tensioned down, the intermediary member 22 of this alterative embodiment truck can still make frictional contact with the shock absorbing pivot cup 5 in its base plate 250. In this same alternative embodiment it can be noticed that the base plate 250 is also much lower than the base plate 15 of the embodiment in FIG. 1, wherein the first embodiment truck 25 incorporates generally parallel positioned bolts 23 and 24. In both novel truck embodiments the keyway slot 33 restrains the movement, and maintains the alignment, of the angled short end 17 of their corresponding keyway bolts, for the purpose of providing precise directional steering capabilities for their corresponding novel truck mechanisms.

The L-shaped keyway bolt 24 can also have a slightly different L shape wherein there is slightly less of an acute angle incorporated into it, such as is depicted in FIG. 13, and in which a typical L-shaped keyway bolt 24 such as in FIG. 1 would have a substantially 90 degree angle incorporated in it, as is detailed by dashed line 134 of FIG. 13. In comparison to dashed line 134, dashed line 133 details the angle of the said alternative embodiment L-shaped bolt 135, which bolt still maintains its predominantly L-shaped geometry and wherein the short end 136 of said alternative L-shaped bolt 135 can also be suitably mated with a keyway slot 33 particularly designed for this alternative embodiment skateboard truck.

With this same alternative design of FIG. 13 the various truck height riser washers 19 can also be installed onto the said alternative L-shaped bolt 135 in the same manner as they are installed on the L-shaped keyway bolt 24 so as to both raise and lower the height of the alternative embodiment truck even as occurs with the first embodiment truck detailed in FIG. 1. This alternative L-shaped bolt 135 can thus provide a different variety of tensioning capabilities in comparison to the L-shaped keyway bolt 24, and wherein the different capabilities might appeal to different skateboard riders, or provide different riding characteristics, suitable for different types of skate riding disciplines currently popular in the sport of skateboarding.

Other similar alternative embodiment components can also be adapted, exchanged, or swapped out with the components detailed in FIGS. 1 through 3. One such possible component is an alternative style shock absorbing pivot cup 110, which is generally formed to be oval or rectangular in shape, and also incorporates an off-set, or off-centered, pivot receiving hole in it. This embodiment can allow for the precise alignment of the various novel skateboard truck components incorporated in the first embodiment truck 25, so as to compensate for various height angle changes caused by the compression of the various elastomeric bushings 13, 38, 54, and 37, if any such precise alignment is desired. Moreover, the heights of the various bushings 13, 38, 54, and 37 can also be altered so as to be formed either shorter or taller than those depicted in FIG. 4, so as to provide a variety of alternate tensioning options for the skateboard rider to choose from, to accomplish his particular riding needs. Differing bushing elasticity durometers can also be used for the various said elastomeric bushings, and that also includes any extra bushings that might conceivably be utilized, or added to, the novel truck mechanisms disclosed in this specification.

By utilizing all of the said novel components, the novel double kingpin skateboard truck of the present invention provides possibly the most diverse and expansive truck-tensioning capabilities of any other skateboard truck currently being utilized in the sport today. It offers the hyper turning capabilities that are already highly desired by multitudes of skateboard riders that are currently utilizing popular double-kingpin skateboard trucks. In addition, this invention provides a very high degree of speed stability to the typical double-kingpin skateboard truck geometry, due to the fact that the said intermediary member 22 of the novel truck 25 can be almost completely restricted in its ability to move, or rotate, on the novel truck mechanism 25, and therefore it can come close to having the speed stability riding characteristics that are possible with single-kingpin skateboard trucks popular throughout the world. This new truck will thus provide a much wider range of skateboard riding options for riders today, such that skaters might enjoy both super tight radius skateboard turning and carving when desired, but then also much safer and more stable higher speed riding when desired, as compared to other double-kingpin skateboard truck designs currently used in the sport of skateboarding.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A skateboard truck insert, comprising:

an intermediary member; and an L-shaped keyway bolt;

wherein said intermediary member comprises a first end, a second end, and a middle section;

wherein said first end of said intermediary member further comprises a through hole;

wherein said through hole receives a kingpin bolt;

wherein said second end of said intermediary member further comprises a blind hole;

wherein said blind hole receives a pivot end of a truck hanger;

wherein said middle section of said intermediary member further comprises a keyway bolt hole and a keyway slot;

wherein said L-shaped keyway bolt further comprises a long threaded end and a short end;

wherein said keyway bolt hole receives said long threaded end of said L-shaped keyway bolt; and wherein said keyway slot receives said short end of said L-shaped keyway bolt.

2. The invention of claim 1, wherein said keyway slot further comprises an insert receiver and an extended keyway;

wherein said L-shaped keyway bolt further comprises a plurality of notches and a notch insert;

wherein said notch insert of said L-shaped keyway bolt sets into said insert receiver of said keyway slot when said L-shaped keyway bolt is installed into said intermediary member; and wherein said plurality of notches of said L-shaped keyway bolt set into said extended keyway of said keyway slot when said L-shaped keyway bolt is installed into said intermediary member.

3. The invention of claim 2, further comprising:

a first bushing;

a first bushing washer;

a second bushing;

a second bushing washer; and a hex nut;

wherein said first bushing is removably attached to a proximal side of said through hole of said first end of said intermediary member;

wherein said first bushing washer is removably attached to a proximal side of said first bushing;

wherein said second bushing is removably attached to a distal side of said through hole of said first end of said intermediary member;

wherein said second bushing washer is removably attached to a distal side of said second bushing;

wherein said kingpin bolt passes through said first bushing washer, said first bushing, said through hole of said intermediary member, said second bushing, and said second bushing washer; and wherein said hex nut is affixed to said kingpin bolt.

4. The invention of claim 3, wherein said short end of said L-shaped keyway bolt is inserted into a pivot cup of a base plate; and wherein said long threaded end of said L-shaped keyway bolt is passed through said keyway slot of said intermediary member and inserted into a truck hanger.

5. The invention of claim 4, wherein said blind hole comprises a rounded bottom; and wherein said short end of said L-shaped keyway bolt comprises a rounded pivot tip.

6. The invention of claim 5, wherein said middle section of said intermediary member abuts said base plate.

7. The invention of claim 6, further comprising:

a plurality of washers;

wherein said plurality of washers are installed on said long threaded end of said L-shaped keyway bolt.

8. The invention of claim 7, wherein said middle section of said intermediary member does not abut said base plate.

9. The invention of claim 8, wherein said kingpin bolt and said L-shaped keyway bolt are parallel.

10. The invention of claim 8, wherein said kingpin bolt and said L-shaped keyway bolt are not parallel.

11. A skateboard truck combination, comprising an intermediary member;

an L-shaped keyway bolt;

a truck base plate; and a truck hanger;

wherein said intermediary member comprises a first end, a second end, and a middle section;

wherein said first end of said intermediary member further comprises a through hole;

wherein said through hole receives a kingpin bolt;

wherein said second end of said intermediary member further comprises a blind hole;

wherein said truck hanger comprises a bolt receiver and a pivot end;

wherein said blind hole receives said pivot end of said truck hanger;

wherein said middle section of said intermediary member further comprises a keyway slot;

wherein said L-shaped keyway bolt further comprises a long threaded end and a short end; and wherein said L-shaped keyway bolt is inserted through said keyway slot of said intermediary member and through said bolt receiver of said truck hanger.

12. The invention of claim 11, wherein said truck base plate comprises a first end and a second end;

wherein said first end of said truck base plate further comprises a bolt receiver;

wherein said second end of said truck base plate further comprises a pivot cup;

wherein said kingpin bolt is inserted through said bolt receiver of said first end of said truck base plate and through said through hole of said first end of said intermediary member;

wherein said short end of said L-shaped keyway bolt is inserted into said pivot cup of said second end of said truck base plate; and wherein said long threaded end of said L-shaped keyway bolt is inserted through said keyway slot of said intermediary member and through said bolt receiver of said truck hanger.

13. The invention of claim 12, wherein said keyway slot further comprises an insert receiver and an extended keyway;

wherein said L-shaped keyway bolt further comprises a plurality of notches and a notch insert;

wherein said notch insert of said L-shaped keyway bolt sets into said insert receiver of said keyway slot when said L-shaped keyway bolt is installed into said intermediary member; and wherein said plurality of notches of said L-shaped keyway bolt set into said extended keyway of said keyway slot when said L-shaped keyway bolt is installed into said intermediary member.

14. The invention of claim 13, further comprising:

a first bushing;

a first bushing washer;

a second bushing;

a second bushing washer; and a hex nut;

wherein said first bushing is removably attached to a proximal side of said through hole of said first end of said intermediary member;

wherein said first bushing washer is removably attached to a proximal side of said first bushing;

wherein said second bushing is removably attached to a distal side of said through hole of said first end of said intermediary member;

wherein said second bushing washer is removably attached to a distal side of said second bushing;

wherein said kingpin bolt passes through said bolt receiver of said first end of said truck base plate, said first bushing washer, said first bushing, said through hole of said intermediary member, said second bushing, and said second bushing washer; and wherein said hex nut is affixed to said kingpin bolt.

15. The invention of claim 14, wherein said blind hole comprises a rounded bottom; and wherein said short end of said L-shaped keyway bolt comprises a rounded pivot tip.

16. The invention of claim 15, wherein said middle section of said intermediary member abuts said base plate.

17. The invention of claim 16, further comprising:

a plurality of washers;

wherein said plurality of washers are installed on said long threaded end of said L-shaped keyway bolt.

18. The invention of claim 17, wherein said middle section of said intermediary member does not abut said base plate.

19. A skateboard combination, comprising an intermediary member;

an L-shaped keyway bolt;

a truck base plate;

a truck hanger; and a skateboard;

wherein said intermediary member comprises a first end, a second end, and a middle section;

wherein said first end of said intermediary member further comprises a through hole;

wherein said through hole receives a kingpin bolt;

wherein said second end of said intermediary member further comprises a blind hole;

wherein said truck hanger comprises a bolt receiver and a pivot end;

wherein said blind hole receives said pivot end of said truck hanger;

wherein said middle section of said intermediary member further comprises a keyway slot;

wherein said L-shaped keyway bolt further comprises a long threaded end and a short end;

wherein said L-shaped keyway bolt is inserted through said keyway slot of said intermediary member and through said bolt receiver of said truck hanger;

wherein said truck base plate comprises a first end and a second end;

wherein said first end of said truck base plate further comprises a bolt receiver;

wherein said second end of said truck base plate further comprises a pivot cup;

wherein said kingpin bolt is inserted through said bolt receiver of said first end of said truck base plate and through said through hole of said first end of said intermediary member;

wherein said short end of said L-shaped keyway bolt is inserted into said pivot cup of said second end of said truck base plate;

wherein said long threaded end of said L-shaped keyway bolt is inserted through said keyway slot of said intermediary member and through said bolt receiver of said truck hanger; and wherein said truck base plate is installed on said skateboard.

20. The invention of claim 19, wherein said keyway slot further comprises an insert receiver and an extended keyway;

wherein said L-shaped keyway bolt further comprises a plurality of notches and a notch insert;

wherein said notch insert of said L-shaped keyway bolt sets into said insert receiver of said keyway slot when said L-shaped keyway bolt is installed into said intermediary member; and wherein said plurality of notches of said L-shaped keyway bolt set into said extended keyway of said keyway slot when said L-shaped keyway bolt is installed into said intermediary member.

* * * * *